United States Patent [19]

Taylor, Jr.

[11] Patent Number: 4,466,487

[45] Date of Patent: Aug. 21, 1984

[54] METHOD AND APPARATUS FOR PREVENTING VERTICAL MOVEMENT OF SUBSEA DOWNHOLE TOOL STRING

[75] Inventor: Jefferson C. Taylor, Jr., Conroe, Tex.

[73] Assignee: Exxon Production Research Co., Houston, Tex.

[21] Appl. No.: 344,325

[22] Filed: Feb. 1, 1982

[51] Int. Cl.[3] ..... E21B 17/01

[52] U.S. Cl. ..... 166/339; 166/348; 166/367; 175/7; 175/321

[58] Field of Search ..... 166/339, 363, 348, 367; 175/7, 58, 321

[56] References Cited

U.S. PATENT DOCUMENTS

| | | | |
|---|---|---|---|
| 3,301,324 | 1/1967 | Smith | 175/7 |
| 3,329,221 | 7/1967 | Walker | 175/7 |
| 3,517,739 | 6/1970 | Rowley | 166/348 |
| 3,587,734 | 6/1971 | Shaffer | 166/363 |

OTHER PUBLICATIONS

Composite Catalog of Oilfied Equipment, p. 2020, 1982–83 Edition.

*Primary Examiner*—William F. Pate, III

*Attorney, Agent, or Firm*—Marc L. Delflache; Mitchell D. Lukin

[57] ABSTRACT

A method and apparatus is disclosed for eliminating vertical motion of a downhole tool in a subsea borehole as the tool is being operated by a drill string from a floating vessel. A vertical motion elimination means is incorporated into the drill string at a point which will be adjacent a blowout preventer stack on the marine bottom when the downhole tool is positioned at a desired point in the borehole. The vertical motion elimination means is comprised of a sleeve which is rotatably mounted on the drill string at a fixed vertical position. The sleeve is adapted to be engaged by the blowout preventer stack to fix the sleeve against vertical movement with respect to the preventer. Since the sleeve, itself, is fixed against vertical movement on the drill string, that portion of the drill string which lies below the preventer (hence, the downhole tool) will also be fixed against vertical motion within the borehole. However, since the drill string is rotatable with respect to the sleeve, the drill string can be rotated while the sleeve is engaged. A plurality of ports are provided in the sleeve to allow fluid circulation through the drill string while the sleeve is engaged by the blowout preventer stack.

12 Claims, 2 Drawing Figures

METHOD AND APPARATUS FOR PREVENTING VERTICAL MOVEMENT OF SUBSEA DOWNHOLE TOOL STRING

DESCRIPTION

1. Technical Field

The present invention relates to subsea operations carried out from a floating vessel and, more particularly, relates to a method and apparatus for preventing vertical motion of a downhole drill string and tool in a subsea borehole which is being drilled or completed from a floating vessel.

2. Background Art

Floating vessels, e.g. drill ships, semisubmersibles, etc., have long been used to drill and complete subsea wells. As understood in the art, operations carried out from floating vessels create problems which are not encountered when the operations are carried out from marine bottom-supported structures. One such problem involves maintaining an operating tool string, e.g. drill string, at a desired vertical position within the borehole of a subsea well when the vessel experiences vertical motion, i.e. "heaves", on the surface. Heave of the vessel is induced primarily by surface conditions, e.g. winds, waves, swells, etc., although additional components of vertical motion may occur whenever the vessel drifts horizontally on the surface.

Several known devices are now available which compensate for heave of a vessel during drilling or completion operations and reduce or minimize downhole movement or weight variations on a downhole tool. One such device is a telescopic slide joint i.e. bumper sub) which is installed into a drill string to allow the drill string to extend or contract as the vessel moves up or down on the surface. Another widely used device is an elastic system known as "heave compensator" which is normally installed on the vessel between the hoisting system and the upper end of a drill string. Heave compensators are designed to automatically raise or lower the drill string relative to the vessel in response to the heave of the vessel.

These devices work well where at least some of the weight of the tool string rests on the bottom of the subsea borehole and where at least one vertical movement of the drill string within the borehole can be tolerated. This is usually the case in routine drilling operations. However, there are certain operations carried out from a floating vessel which cannot tolerate any substantial vertical motion of the drill string once it has been positioned in the borehole. One such operation involves taking core samples from loosely consolidated sands or like formations which transverse the borehole. Due to the consistency of such formations, special coring tools and techniques are required to recover cores which are undisturbed and representative of the formation being sampled. These cores are physical samples of the oil or gas reservoir and are analyzed and tested in the laboratory. Cores are used to determine the type of fluid content in the reservoir rock (core) sample (i.e., oil, gas or water content) and to provide estimates of its potential producing characteristics (i.e, porosity, permeability, etc.).

As well known tool for recovering such undisturbed core samples from such formations is commonly referred to as a "rubber sleeve core barrel". This tool is comprised of a housing having telescopic upper and lower sections. The lower section carries the core bit on its lower end. When the tool is in an operable position on the bottom of the borehole, the housing is in a collapsed position. Instead of advancing the drill string to move the tool ahead as is done in conventional drilling and with many other coring tools, the drill string is rotated and circulating fluid (e.g. drilling mud) applies pressure on the lower section to advance it downward with respect to the upper section to cut the core from the formation.

Downward movement of the lower section mechanically pulls a rubber sleeve, which is folded within the tools, into position to encase the core as the core is received into the tool. Drilling of the core is continued until the housing is fully extended (i.e. 2 feet). Then the fluid circulation is shut down and the drill string is lowered (i.e. 2 feet) to again collapse the housing. The above procedure can be repeated several times until the desired length of the core (e.g. 20 feet) is drilled and received into the tool.

Since the rubber sleeve is mechanically fed into position upon downward movement of the lower section of the tool, any excessive "jacking" of the housing, such as that caused by the heave of the vessel, will cause a premature feeding of the rubber sleeve which, in turn, adversely affects the operations of the tool. Therefore, it can be seen that for this coring tool to be successful, all vertical movement of the drill string within the borehole must be eliminated while the lower section is extended to cut the core.

There are also other operations that are carried out from floating vessels which require zero vertical motion of a drill, production or test string in a subsea borehole. For example, cutters mounted on a drill string are used to mill through casing in the borehole below a wellhead to recover the wellhead, blowout preventer stack, guide base, or other related equipment on the marine bottom. These operations, as well as the coring operation described above, require that the drill string be fixed against vertical movement within the borehole but, at the same time, be free for rotation therein.

DISCLOSURE OF THE INVENTION

The present invention provides a method and apparatus for eliminating vertical motion of downhole tool which is being operated from a floating vessel to carry out operations in a subsea borehole. Although the tool is fixed against vertical motion, it remains free to rotate within borehole. Further, circulation of fluid can be maintained through the operating drill string while the tool is carrying out its desired operation.

More specifically, the present invention uses a vertical motion elimination means which is incorporated into the operating drill string. Preferably, this elimination means is comprised of a sleeve which is rotatably mounted onto an operating drill string at a fixed vertical position. The sleeve is positioned at a point on the operating string so that when the downhole tool carried by the drill string lies at a desired point in the borehole, the sleeve will lie adjacent a blowout preventer stack which, in turn, is positioned on the marine bottom at the entry of the borehole.

Upon actuation of the blowout preventer, an element therein moves outward to grip that portion of the sleeve which lies adjacent thereto to fix the sleeve against vertical movement with respect to the blowout preventer. Since the sleeve is vertically fixed on the drill string, the portion of the drill string below the blowout preventer and, hence, the tools on the lower end thereof are also fixed against vertical movement. However, since the drill string is free to rotate relative to the sleeve, the drill string can rotate even while the sleeve is engaged by the blowout preventer. This isolates the downhole tool from the effects of the heave of the vessel while the desired operations, e.g. coring operations, are being carried out in the borehole.

Preferably, the length of the sleeve is greater than the length of the bore through the blowout preventer. Thus some portion of the sleeve will lie adjacent the blowout preventer as the downhole tool is repositioned in the borehole for each incremental step. Further, ports may be provided in the sleeve which are spaced so that a first set of ports will lie above the engaging element of the blowout preventer and a second set of ports will lie below the engaging element. Thus fluid can be circulated through the drill string while the blowout preventer is actuated.

BRIEF DESCRIPTION OF THE DRAWINGS

The present invention will be better understood by referring to the drawings in which like numerals identify like parts and in which.

BEST MODES OF CARRYING OUT THE INVENTION

Figure 1:
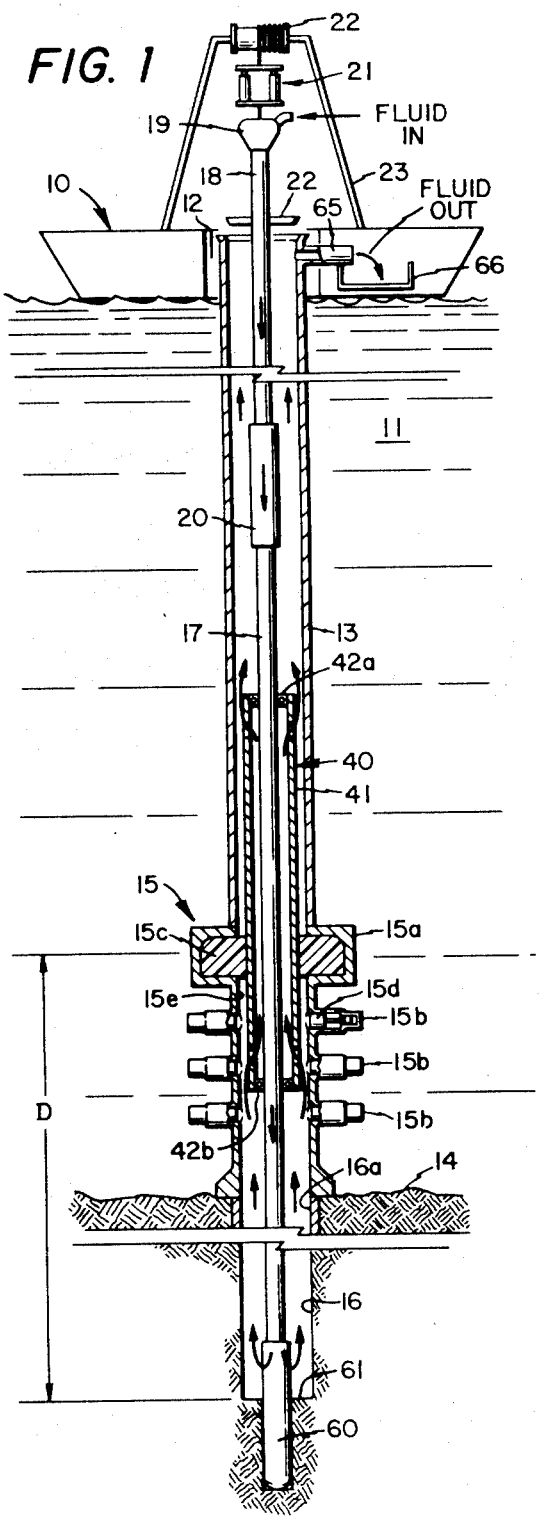
FIG. 1 is a sectional view of a subsea operation which incorporated the present invention being carried out from a floating vessel.

Referring more particularly to the drawings, FIG. 1 discloses the present invention as used in a typical floating drilling operation. Floating vessel 10 is positioned on the surface of the body of water 11 over a subsea drilling site. Vessel 10 is illustrated as having a ship-shaped hull but it will be understood that the present invention can be carried out equally well from other floating vessels (e.g. semi-submersible, caisson vessel, etc.). Vessel 10 has an opening or "moonpool" 12 in its hull through which the drilling operations are carried out.

A drilling riser 13 extends from moonpool 12 to marine bottom 14 where it is connected to BOP (blowout preventer) stack 15. BOP stack 15, having a bore 15(e) therethrough, is mounted on surface casing 16*a* of subsea borehole 16. As illustrated, BOP stack 15 is comprised of an annular blowout preventer 15*a* stacked onto a plurality of ram-type blowout parameters 15*b*. However, it will be understood from the following description that both types of preventers do not need to be used at the same time or even used in combination. Moreover, it will be understood from the following description that other types of well-known blowout preventers can be used equally well with the present invention.

Drill string 17, also referred to hereinafter occasionally as a tool string, extends through riser 13 and into subsea borehole 16. The drill string 17 includes a standard kelly 18 and a drill swivel 19 at the upper end of the string. A telescopic slide joint or bumper sub 20 of the type commonly used in floating drilling operations may be positioned in drill string 17. The use of a sub 20 will depend on whether all or only part of the weight of the drill string is to be supported by the BOP stack since a sub 20 is typically not designed to support a long length of drill string. On the other hand, a heave compensating system 21, which may be any of many commercially-available "heave compensator" systems, is positioned between drill swivel 19 and hoisting system 22. Heave system 21 is typically built to accommodate large loads. The hoisting system 22 is supported by derrick 23 on vessel 10. As will be recognized by those skilled in the art, all of the structure described to this point is well known and is intended to be representative of the equipment used in a typical floating drilling operation.

In accordance with the present invention, a vertical motion elimination means 40 is incorporated into drill string 17. Vertical elimination means 40, as illustrated in FIG. 1, is comprised of sleeve 41 which is rotatably mounted on drill string 16 by spaced bearing assemblies 42*a*, 42*b*. Bearing assemblies 42*a*, 42*b* are fixed against vertical movement on drilling string 17.

Figure 2:
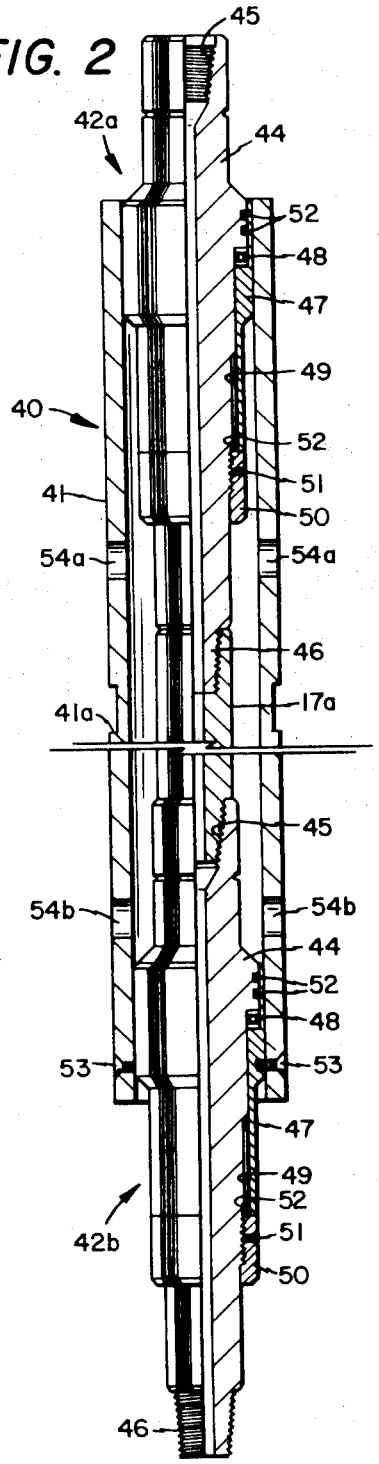
FIG. 2 is a perspective view, partly in section, of a preferred embodiment of the vertical motion elimination means of the present invention.

In a preferred embodiment illustrated in FIG. 2, upper and lower bearing assemblies 42*a*, 42*b*, respectively, are identical in construction. Each assembly is comprised of a mandrel 44 having threaded connections 45, 46 on the ends thereof. Housing 47 is rotatably mounted on mandrel 44 by means of thrust bearing 48 and radial bearing 49. Housing 47 is held in place by bearing preload ring 50 and lock screw 51. Packing 52 is provided to protect the bearings from fluid erosion. Although bearing assemblies 42*a*, 42*b*, as described, are commerically available units, i.e. A-Z Marine Swivel, Type MSB-10 or MSA-10, available from A-Z International Tool Co., Houston, Tex. (for details see pp. 187-188 of *Composite Catalog of Oil Field Equipment and Services*, 1978-79, published by World Oil, incorporated herein by reference), it should be understood that these assemblies could be of different constructions without departing from the present invention. It is only necessary that housing 47 be rotatably mounted but vertically fixed on drill string 17.

Again referring to FIG. 2, mandrels 44 of bearing assemblies 42*a*, 42*b* are coupled together with a length (e.g. 30 to 40 feet) of conduit, such as drill pipe 17*a* or the like, to form a mandrel element for means 40. This assembly is then positioned into sleeve 41 which, in turn, is formed of a corresponding length of heavy tube such as casing. The length of the conduit (e.g. 30 to 40 feet) may be greater than the length of bore 15(e) of BOP stack 15. The upper and lower ends of sleeve 41 are secured to housings 47 of bearing assemblies 42*a*, 42*b*, respectively by any suitable means, e.g. welding, threading, set screws 53 (FIG. 2), or the like. It can be seen that sleeve 41 can rotate relative to the mandrel element but cannot move vertically with respect thereto. A plurality of ports 54*a*, 54*b* are provided by sleeve 41 near its upper and lower ends, respectively, for a purpose described below. Vertical motion elimination means 40 is then ready to be coupled into drill string 17 to form an integral part thereof.

In operation, a downhole tool 60 is attached to drill string 17 and additional sections of drill string are made up on vessel 10 as downhole tool 60 is lowered through riser 13. When a length of drill string 17 has been assembled which substantially equals the distance D from BOP stack 15 to a predetermined point 61 within borehole 16, vertical elimination means 40 is connected into drill string 17. Additional sections of drill string, including bumper sub 20, are made up until tool 60 is lowered to point 61 in borehole 16. Kelly 18 and swivel 19 are then connected to the upper end thereof as is known in the art.

When tool 60 is positioned at its desired position 61 in borehole 16, some portion of sleeve 41 will lie adjacent BOP stack 15. One or more of the blowout preventers 15*a*, 15*b* are then actuated so that their respective sealing elements engage and grip sleeve 41, thereby holding it against vertical and rotational movement. As illustrated in FIG. 1, an annular blowout preventer 15*a* is set and rubber packing element 15*c* therein is in engagement with sleeve 41. Preferably, annular blowout preventer 15*a* is of the type having a plurality of steel segments or fingers (not shown) embedded in element 15*c* which move outward into gripping contact with sleeve 41 upon application of actuating pressure. One such commerically-available blowout preventer is the annular blowout preventer sold by Hydril of Houston, Tex. (see pp. 3824–3829, *Composite Catalog of Oil Field Equipment and Services,* 1980–1981, published by World Oil, incorporated herein by reference), and the Spherical Blowout Preventer, sold by NL Shaffer/NL Industries, Inc. of Houston, Tex., (see pp. 4868 et seq. *Composite Catalog of Oil Field Equipment and Services,* 1978–79, published by World Oil, incorporated herein by reference). The steel fingers in this type of blowout preventer may make uniform indentations approximately one inch deep around sleeve 41 but will not result in conventional collapse of sleeve 41. Any deformation caused by the fingers into sleeve 41 greatly increases the load carrying ability of preventer 15*a* and will not damage the present invention.

If ram-type blowout preventers 15*b* (e.g. Types V or R Ram BOP, available from Hydril, Houston, Tex. see pp. 3622–3627, *Composite Catalog of Oil Field Equipment and Services,* 1978–79, published by World Oil, incorporated herein by reference) are used instead of the annular blowout preventer 15*a* to grip sleeve 41, sleeve 41 can be notched, e.g. circumferential notches 41*a*, at desired spacings (e.g. every one or two feet) along its length. This will insure that some of the notches will receive the pipe or blank rams 15*d* (only one shown in FIG. 1) of an adjacent blowout preventer. In this manner, means 40 is fixed against vertical movement. Alternately, an expendable casing can be used for sleeve 41 since it may incur substantial deformation upon engagement by the blowout preventer.

While the preferred embodiment, as described above, is illustrated as having two bearing assemblies 42*a*, 42*b*, it should be understood that in some instances, only one such assembly may be used. For example if only lower bearing assembly 42*b* is used, the upper portion of sleeve 41 is left unattached and is free to float since it will have a built-in tendency to remain concentric and thereby remain centered. If additional stabilization of the upper portion of sleeve 41 is considered necessary, fins or a wear sleeve (not shown) can be positioned between drill pipe 17 and sleeve 41.

Upon engagement by elements of BOP stack 15, sleeve 41 will be latched and vertical motion through BOP stack 15 is not possible. Accordingly, that section of drill string 17 which lies below means 40 will also be fixed against vertical movement in borehole 16. Any heave experienced by vessel 10 while means 40 is engaged by BOP stack 15 will be compensated for by bumper sub 20 and/or heave compensating means 21, but the heave of the vessel will not cause downhole tool 60 to move vertically within borehole 16.

Since the mandrel element (i.e. mandrels 44 and conduit 17*a*) is free to rotate with respect to the housings 47 and sleeve 41, drill or tool string 17 can be rotated to operate tool 60 while sleeve 41 is gripped by the BOP stack 15. Furthermore, ports 54*a*, 54*b* at the upper and lower ends, respectively, of sleeve 41 allow normal fluid (e.g. drilling mud) circulation through subsea borehole 16 while sleeve 41 is gripped by BOP stack 15. That is, fluid enters drill swivel 19, flows down drill string 17 and out downhole tool 60, up the borehole annulus, into and out of sleeve 41 through ports 54*b* and 54*a*, respectively, up through riser 13, and out mud return line 65 into mud processing equipment 66 on vessel 10 (see arrows in FIG. 1). Obviously, based on this disclosure, one skilled in the art will realize that ports 54*a* and 54*b* are not the only way to continue circulation if the BOP stack has engaged the sleeve and blocked the annulus between the drill string and casing. For example, a by-pass line (not shown) may be installed around the BOP stack (e.g. choke or kill lines) to permit continued circulation of drilling fluid to the tool and back to the vessel.

If it becomes necessary to move downhole tool 60 to a new location, BOP stack 15 is disengaged from the sleeve 41, drill string 17 is lowered, and BOP stack 15 is again actuated to grip sleeve 41 at a new position. In this event the length of sleeve 41 is preferably long enough to permit movement of tool 60 through its desired vertical range in borehole 16 and still permit contact surface between the sleeve and the BOP stack.

To further understand the present invention, an example of a specific operation will now be described as it would be carried out from vessel 10 using the present invention. The operation is one wherein downhole tool 60 is a coring tool used to take an undistrubed core sample from an unconsolidated formation. As will be recognized by those skilled in the art, recovering a truly representative core of any substantial length from such formations requires special tools and handling procedures.

One such tool well known in the art as the "rubber sleeve core barrel" commercially available from Christensen Diamond Products, U.S.A. of Salt Lake City, Utah. Although a brief description of a rubber sleeve core barrel will be set forth below, the structure has not been shown in the drawings. For a complete description of a rubber sleeve core barrel, see page 1674 of the *Composite Catalog of Oil Field Equipment and Services,* 1978–79, published by World Oil and incorporated herein by reference.

Briefly, the rubber sleeve core barrel is comprised of a splined, telescopic housing having an upper section attached to drill string 17 and a lower section which carries the bore bit. An internal piston which is activated by the circulating mud advances the lower section thereby applying the necessary pressure on the core bit without requiring the advancement of the drill string as is the case in conventional coring operations. The lower section is rotated by drill string 17 through the upper section as the lower section advances to cut the core.

A rubber sleeve which is folded in the tool is mechanically pulled into position by the downward movement of the lower section and encases the core sample as it is cut and received into the tool. The housing has a two-foot stroke so that when two feet of core has been cut, circulation is stopped and the drill string is advanced to reset the housing. The above procedure is then repeated until the desired length of the core (e.g. 20 feet) is cut and received in the tool. If excessive "jacking" of the tool occurs because of vessel heave, the rubber sleeve is fed out prematurely and is not available to receive the core as it is cut.

In accordance with the present invention, a rubber sleeve core barrel (i.e. tool 60 in FIG. 1) is positioned on drill string 17 which, in turn, is assembled and lowered as described above. When tool 60 reaches the top of the formation (point 61 in FIG. 1), a lower portion of vertical motion elimination means 40 will lie adjacent blowout preventer 15*a*. Preventer 15*a* is actuated to move element 15*c* into firm gripping contact with sleeve 41 to latch it against vertical movement.

Fluid is then circulated down drill string 17 while the drill string is being rotated by table 24 to apply pressure on and advance the lower section of tool 60 to cut a first two foot section of core from the formation. During this operation, the circulating fluid flows back to vessel through means 40 and riser 13. After the stroke of tool 60 is completed, circulation of fluid and rotation of drill string 17 is stopped and preventer 15*a* is disengaged from the sleeve 41. Drill string 17 is lowered two feet to reset tool 60 and preventer 15*a* is again actuated to reengage sleeve 41 at a new position. This procedure is repeated until the desired length of core is cut. It can be seen that once sleeve 41 is engaged by preventer 15*a*, that portion of drill string 17 in borehole 16 and, hence, tool 60 cannot move vertically but is free to rotate. This effectively isolates tool 60 from the effects of any heave which might be experienced by vessel 10.

In summary, the present invention can be used for carrying out any floating drilling or completion operation which requires zero vertical motion of a downhole tool. In addition to the coring operation described, the present invention can be used in casing milling operations wherein tool 60 is comprised of any of several commercially-available marine casing cutters, e.g. A–Z Type C Maring Casing Cutter available from A–Z International Tool Co., Houston, Tex. (for details see p. 174 of *Composite Catalog of Oil Field Equipment and Services*, 1978–1979, published by World Oil and incorporated herein by reference).

The present invention has been described in terms of a preferred embodiment. Modification and alterations to this embodiment will be apparent to those skilled in the art in view of this disclosure. It is, therefore, intended that all such equivalent modifications and variations fall within the spirit and scope of the present invention as claimed.

What is claimed is:

1. Apparatus for carrying out an operation at a desired point in a subsea borehole drilled into the marine bottom, said apparatus comprising:

a floating vessel;

blowout preventer means positioned on said marine bottom at and in communication with the upper end of said subsea borehole;

a drill string extending from said vessel, through said blowout preventer means, and into said subsea borehole;

a downhole tool carried by the lower end of said drill string; and a vertical motion elimination means mounted for relative rotational movement on said drill string but fixed against vertical movement thereon, said means being positioned on said drill string at a point being adjacent said blowout preventer when said downhole tool lies adjacent said desired point in said subsea borehole, said vertical motion elimination means being adapted to be engaged by said blowout preventer means when said blowout preventer means is activated to fix said downhole tool against vertical motion within said borehole, while allowing circulation of fluid from said vessel through said drill string and back to said vessel through said vertical motion elimination means.

2. The apparatus of claim 1 wherein said vertical motion elimination means comprises:

a pair of bearing assemblies, each assembly comprising:

a mandrel having a passage therethrough;

a housing;

bearing means for rotatably mounting said housing at a fixed vertical position on said mandrel; and means for connecting said mandrel into said drill string to form an integral part thereof;

a length of conduit connecting said mandrels of said bearing assemblies together in spaced relationship;

a sleeve surrounding said spaced bearing assemblies; and means for securing said sleeve to said housings of said spaced bearing assemblies.

3. The apparatus of claim 2 further comprising:

ports in said sleeve near the upper and lower ends thereof to allow fluid flow between the exterior and interior of said sleeve.

4. The apparatus of claim 3 wherein the length of said sleeve is greater than that of the bore of said blowout preventer means so that said drill string can be moved to a different desired point in said subsea borehole with said sleeve still being adjacent said blowout preventer means.

5. A vertical motion elimination apparatus adapted to be connected into and form an integral part of a drill string of the type used in carrying out operations in a subsea borehole from a floating vessel, said apparatus comprising:

an upper mandrel having a fluid passage therethrough adapted to align with the fluid passage of said drill string when said mandrel is connected into said drill string;

a lower mandrel having a fluid passage therethrough adapted to align with the fluid passage of said drill string when said mandrel is connected into said drill string;

means on said mandrels for connecting said mandrels into said drill string;

a length of conduit connecting said upper and lower mandrels together in a spaced relationship;

a first housing;

bearing means for rotatably mounting said first housing at a fixed vertical position on said upper mandrel;

a second housing;

bearing means for rotatably mounting said second housing at a fixed vertical position on said lower mandrel;

a sleeve surrounding said bearing means and said conduit;

a first set of ports in said sleeve near the upper end thereof; p1 a second set of ports in said sleeve near the lower end thereof to allow fluid flow between the exterior and interior of said sleeve;

means for rotatably mounting said sleeve in a fixed vertical position on said mandrels; and means for engaging said first and second housings to said means for rotatably mounting said sleeve.

6. The apparatus of claim 5 wherein said sleeve comprises:

a casing adapted to be deformed upon engagement by an element of a blowout preventer of the types commonly used in subsea operations.

7. The apparatus of claim 5 wherein said sleeve comprises:

a sleeve having a plurality of circumferentially extending notches vertically spaced along an intermediate portion of its length, each notch adapted to independently receive a ram element of a blowout preventer.

8. A method of carrying out an operation in a subsea borehole with a drill string which extends from a floating vessel through a blowout preventer on the marine bottom, and into said subsea borehole, said method comprising:

affixing to said drill string a downhole tool which is capable of carrying out said operation;

inserting vertical motion elimination means in said drill string at a predetermined location whereby said vertical motion elimination means will be adjacent said blowout preventer when said downhole tool is positioned at a desired point in said subsea borehole, said vertical motion elimination means being mounted for relative rotational movement with respect to said drill string but fixed against vertical movement thereon;

lowering said downhole tool to said desired point in said subsea borehole;

actuating said blowout preventer to engage said vertical motion elimination means on said drill string whereby said downhole tool is fixed against vertical movement within said borehole at said desired point;

circulating a fluid from said vessel through said drill string and back to said vessel through said vertical motion elimination means; and operating said downhole tool to carry out said operation.

9. The method of claim 8 wherein said downhole tool comprises a means for milling casing.

10. The method of claim 8 further comprising:

casing operation of said downhole tool;

deactuating said blowout preventer to disengage said blowout preventer from said vertical motion elimination means on said drill string;

repositioning said downhole tool at a second desired point in said subsea borehole;

reactuating said blowout preventer to again engage said vertical motion elimination means at a different point thereon whereby said downhole tool is fixed against vertical movement at said second desired point in said subsea borehole; and operating said borehole tool to again carry out said operation at said second desired point.

11. The method of claim 10 wherein said downhole tool comprises a rubber sleeve core barrel.

12. A method of carrying out an operation in a subsea borehole with a drill string which extends from a floating vessel through a blowout preventer on the marine bottom, and into said subsea borehole, said method comprising:

affixing to said drill string a downhole tool which is capable of carrying out said operation;

inserting vertical motion elimination means in said drill string at a predetermined location whereby said vertical motion elimination means will be adjacent said blowout preventer when said downhole tool is positioned at a desired point in said subsea borehole, said vertical motion elimination means being mounted for relative rotational movement with respect to said drill string but fixed against vertical movement thereon;

lowering said downhole tool to said desired point in said subsea borehole;

actuating said blowout preventer to engage said vertical motion elimination means on said drill string whereby said downhole tool is fixed against vertical movement within said borehole at said desired point;

circulating a fluid from said vessel through said drill string and back to said vessel through said vertical motion elimination means;

operating said downhole tool to carry out said operation;

ceasing operation of said downhole tool;

deactuating said blowout preventer to disengage said blowout preventer from said vertical motion elimination means on said drill string;

repositioning said downhole tool at a second desired point in said subsea borehole;

reactuating said blowout preventer to again engage said vertical motion elimination means at a different point thereon whereby said downhole tool is fixed against vertical movement at said second desired point in said subsea borehole; and operating said downhole tool to again carry out said operation at said second desired point.

* * * * *

UNITED STATES PATENT AND TRADEMARK OFFICE

CERTIFICATE OF CORRECTION

PATENT NO. : 4,466,487

DATED : August 21, 1984

INVENTOR(S) : Jefferson C. Taylor

It is certified that error appears in the above-identified patent and that said Letters Patent are hereby corrected as shown below:

At line 45 of column 1, delete "one" and insert therefor --some--;

At line 41 of column 6, delete "as" and insert therefor --is--;

At line 64 of column 8 (claim 5), delete "pl".

Signed and Sealed this

*Twelfth* Day of *February 1985*

[SEAL]

*Attest:*

DONALD J. QUIGG

*Attesting Officer*

*Acting Commissioner of Patents and Trademarks*